United States Patent [19]

Thorne

[11] Patent Number: 4,540,296

[45] Date of Patent: Sep. 10, 1985

[54] BAR BAND INTERSECTIONAL MATRIX PRINTER

[75] Inventor: William D. Thorne, Wake Forest, N.C.

[73] Assignee: International Business Machines Corporation, Armonk, N.Y.

[21] Appl. No.: 484,734

[22] Filed: Jul. 5, 1983

Related U.S. Application Data

[63] Continuation of Ser. No. 333,090, Dec. 21, 1981, abandoned.

[51] Int. Cl.[3] ..... B41J 3/12; B41J 1/20

[52] U.S. Cl. ..... 400/121; 400/146; 101/111; 101/93.04

[58] Field of Search ..... 101/93.14, 93.15, 111, 101/93.04; 400/146, 662, 121

[56] References Cited

U.S. PATENT DOCUMENTS

| | | | |
|---|---|---|---|
| 2,656,240 | 10/1953 | Hell | 400/125.1 |
| 3,324,240 | 6/1967 | Klienschmidt et al. | 101/93.04 |
| 3,480,127 | 11/1969 | Hesse et al. | 400/662 |
| 3,799,313 | 3/1974 | Shevick | 400/662 |
| 3,810,195 | 5/1974 | Kilroy et al. | 346/101 |
| 3,890,895 | 6/1975 | Deproux | 101/93.14 |
| 3,926,293 | 12/1975 | Ljungberg | 101/93.16 |
| 4,068,583 | 1/1978 | Sato et al. | 101/93.04 |
| 4,273,040 | 6/1981 | Sebrosky et al. | 101/93.04 |
| 4,278,019 | 7/1981 | Meier | 101/93.04 |
| 4,285,275 | 8/1981 | Sato | 400/662 |
| 4,312,269 | 1/1982 | Komatsu et al. | 101/93.04 |
| 4,326,814 | 4/1982 | Schaffer et al. | 101/93.04 |

FOREIGN PATENT DOCUMENTS

| | | | |
|---|---|---|---|
| 0036970 | 10/1981 | European Pat. Off. | 400/146 |
| 0043434 | 1/1982 | European Pat. Off. | 400/146 |
| 2276937 | 1/1976 | France | 400/146 |
| 155775 | 12/1981 | Japan | 101/93.04 |

OTHER PUBLICATIONS

Helinski et al., "Dot Matrix Printer", IBM Technical Disclosure Bulletin, vol. 20, No. 9, p. 3408, 2/78.

Barrekette, "Matrix Printer", IBM Technical Disclosure Bulletin, vol. 20, No. 1, pp. 438–439, 6/77.

*Primary Examiner*—William Pieprz

*Attorney, Agent, or Firm*—Edward H. Duffield

[57] ABSTRACT

A dot matrix printer is described in which the dots are formed by impact at an intersection between a raised ridge on a platen and a vertical ridge or bar font member. A moving belt carries a plurality of individually mounted vertical bar segments. The bar segments are each mounted on a flexible finger and can be deflected out of the path of the moving belt by impact from a print hammer mechanism. The vertical bars may be caused thusly to individually impact against a platen arranged parallel to the line of travel of the fingers. The platen may have a plurality of raised knife-edge ridges on its surface. By appropriate timing of hammer actuations, individual bar elements may be caused to impact against the knife-edge ridges on the platen. If the paper and ribbon are interposed between the bar fingers and the knife-edge ridges, a mark in the shape of the intersectional area between the bar and the knife-edge ridge can be made. If the knife-edge ridges are angled with respect to the direction of travel of paper, continuously moving paper and associated transport mechanisms may be advantageously employed. By appropriate timing of the hammer firings, together with angling of the knife-edge ridges on the platen and selection of paper translation velocity, a linear array of dots may be produced in a single row. Various other arrays of dots in succeeding rows can similarly be generated to build up desired character shapes or patterns. The mechanism reduces or eliminates the shadow printing problem inherent in intersectional printers of the type involved and enables equivalent throughput to be obtained with continuously moving paper with reduced peak power requirements.

4 Claims, 3 Drawing Figures

BAR BAND INTERSECTIONAL MATRIX PRINTER

This is a continuation of application Ser. No. 333,090 filed Dec. 12-21-81 now abandoned.

FIELD OF THE INVENTION

This invention relates to dot matrix printers in general and to dot matrix printers of the intersectional type in particular where the resulting dot is formed by the intersection between a font element and a platen element.

PRIOR ART

A variety of dot matrix intersectional printers exists. U.S. Pat. No. 4,068,583 is one such example. In this example, dots are formed by the intersection between vertical bars carried by a moving band and an elongated horizontally placed knife edge hammer. A dot is made at the intersection between the horizontal hammer knife-edge face and the vertical bar moving with the moving belt. The direct intersection between the hammer and the bar element on the belt, with the belt element acting as a platen, makes a mark by utilizing a paper and a ribbon which may be interposed between the two members.

In designs of this sort, shadow printing is a well-known problem. A wide hammer (one having an elongated impact face) often used for cost considerations to span a plurality of character widths, tends to move an adjacent portion of the paper against a preceding or succeeding vertical bar element on the moving band/-platen. This is known as shadow printing or smearing and is an undesirable result as will be readily appreciated.

In addition, the accurate timing of impact between a moving hammer knife face and a moving vertical bar/-platen is a more demanding and critical physical problem than would ordinarily be desirable.

Another prior art device is shown in the IMB Technical Disclosure Bulletin, Vol. 20, NO. 9, February 1978, page 3408, showing a device similar to that in the aforementined U.S. patent and suffering from the same general deficiencies.

It is well known from each of these references that slanted hammers and knife edges or the like may be employed to account for continuously moving paper. In this manner serially formed dots will be aligned in the same row on moving paper. However, the degree of difficulty in accurately forming horizontal dot lines when both the hammer face and the intersecting bar/-platen are moving can result in inaccurate registration of the resulting dots.

OBJECTS OF THE INVENTION

In view of the foregoing difficulties with the known prior art, it is an object of this invention to provide an improved intersectional dot matrix printer in which a fixed platen and non-intersecting hammer face may be employed with a single movable element, namely, the font element to produce intersectional matrix printing.

SUMMARY

The foregoing and other unenumerated objects of the present invention are met by providing a continuously moving band carrying bar-shaped font elements. The moving font elements are interposed between individual hammer faces and a fixed platen. The platen has one or more inclined projecting ribs or ridges. The intersection between the vertically arranged font element, which is in the form of a raised bar or ridge, and the raised ridge or rib on the platen creates a dot upon paper or other suitable medium interposed between the two. Either action paper of the sort that can be marked by impact alone or plain paper with the addition of a movable marking media such as an inked ribbon or the like may be similarly employed. By making the individual vertical bar elements on the moving belt independently movable outward from the belt to impact the raised ridges on the platen, the design avoids the shadow printing problem. Only as much paper or ribbon as is in the immediate proximity to the narrow vertical font element is displaced. Moreover, since the hammer face does not itself impact the raised ridges on the plate, the expensive hammer assembly is not subjected to as severe a wear condition as would otherwise be the case.

BRIEF DESCRIPTION OF THE DRAWINGS

A preferred embodiment of the present invention will now be described with reference to the accompanying drawings in which the figures are as follows.

DETAILED SPECIFICATION

Figure 1:
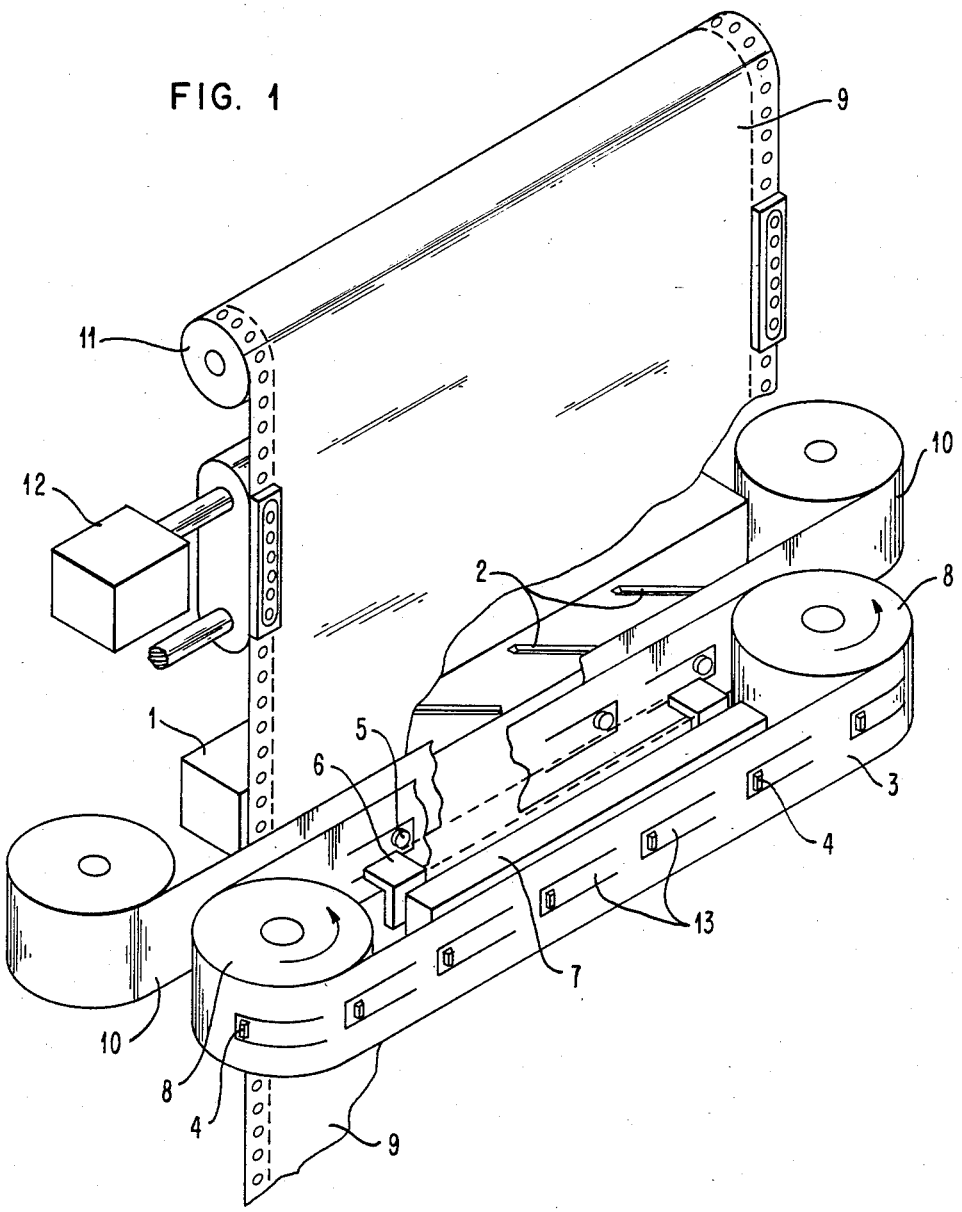
FIG. 1 is a semi-pictorial schematic diagram showing the basic overall mechanical arrangement and the important elements of the present invention in a preferred embodiment thereof.

Turning to FIG. 1, the overall layout of the mechanical components essential to the preferred embodiment of the invention are depicted in a semi-pictorial arrangement. The individual elements will be described in greater detail below, but are briefly described not as a general aid to understanding the invention.

In FIG. 1, the platen 1 is made of hardened steel or other similar material to resist the repeated wear of impact and abrasion. Platen 1 is provided with a series of slightly inclined raised ridges 2 which are the impact faces of the platen against which the vertical bar print elements 4 on moving band 3 may be struck. They are struck by the hammers 6 impacting against anvils 5 on the back faces of the fingers 13 in the band 3. A bank of print hammer drivers of the ordinary sort known in the prior art contain magnetic coils or similar drive apparatus for driving the hammers 6 in the direction toward platen 1. The impact faces of the hammers 6 impact anvils 5 in their flight past the face of the hammers in the hammer bank.

Paper 9 and a printing ribbon 10 are interposed between platen 1 and the band 3 for making marks on the paper. A mark is created at the intersectional area between the raised ridge 2 of platen 1 and the impact bar 4 which is a raised ridge on finger 13 carried by band 3. The raised ridges 2 on platen 1 are inclined slightly as shown. Paper 9 is continuously moved in an upward direction in the figure and the band 3 progresses from right to left as shown. A horizontal line of dots can be created by appropriately timing hammer impacts against the anvils 5 to create the first dots at the right-hand edge of each ridge 2. These dots will move upward with the continuous motion of paper 9. Paper 9 may be driven by a suitable drive motor 12 and tractors 11 well known in the art. Succeeding dots will be struck by repeated hammer impact against the anvils as the fingers 13 with the moving bar elements 4 progress from right to left scanning across the faces of the ridges 2. The degree of incline is a function of the speed of the band and of the moving paper as will be appreciated by those skilled in the art.

Ribbon 10 is shown to be slightly angled across the face of the platen 1 to distribute the wear area across the full height of the ribbon as is similarly well known in the printer arts.

It will be instantly appreciated that by numerous hammer strikes a horizontal row of single dots can be created and that succeeding rows of dots can be similarly created to generate characters, patterns, numerals or any desired shapes within the vertical and horizontal pel limitations inherent in the mechanism which will be discussed later.

Figure 2:
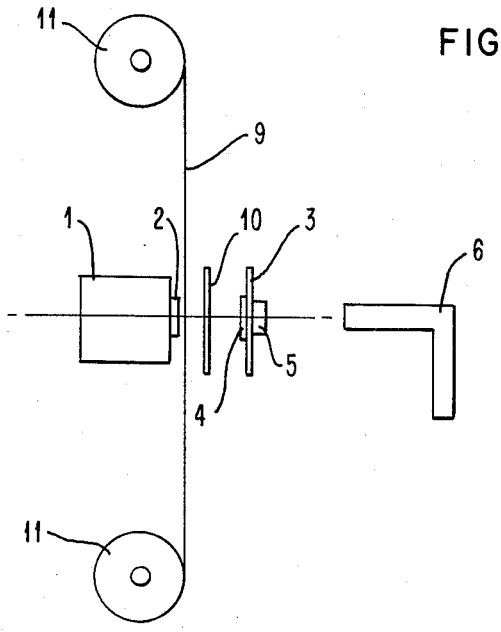
FIG. 2 is a schematic horizontal cross-section taken through a print hammer, the platen, and a moving font element to illustrate the relative placement of the individual elements in FIG. 1.

Turning to FIG. 2, a schematic horizontal cross-section through the major elements as shown in FIG. 1 is depicted. Platen 1 is seen end on with a raised ridge 2 on its impact face. The paper 9, ribbon 10 and the drive tractors 11 are also schematically indicated in their relative positions. The raised vertical bar on fingers 13 is shown as bar 4. An anvil 5 is affixed to the finger 13, not visible in FIG. 2, and is arranged colinear with the impact face of the hammer 6.

Figure 3:
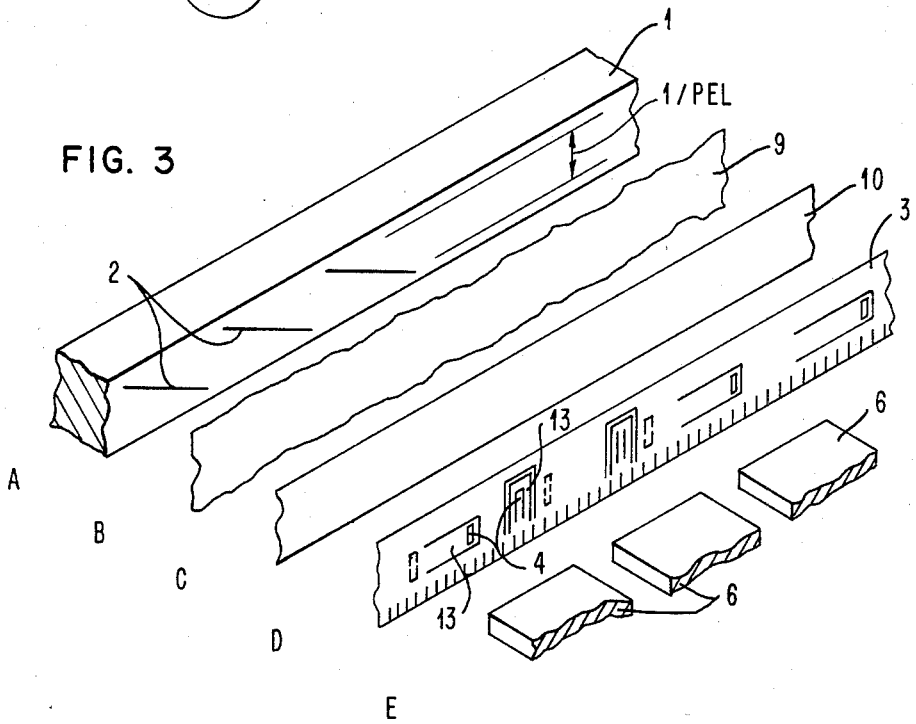
FIG. 3 is an exploded pictorial segment of several of the elements in FIGS. 1 and 2 showing in greater detail the placement and arrangement of the vertical raised font bars on a moving band the relationship to the ribbon, the paper and platen.

Turning to FIG. 3, an exploded pictorial view showing the arrangement of the basic elements and further indicating some details of the band 3 are shown. FIG. 3 is arranged from top to bottom showing the platen, the paper, the ribbon, the band, and the hammer faces in their order of assembly to indicate a back to front depth arrangement, as shown in FIG. 2.

As shown in FIG. 3, each raised ridge 2 is inclined to span a vertical distance equal to 1 divided by the vertical pel.

The paper 9 is assumed to move in the upward direction as shown in the arrow. The ribbon 10 may move either left or right, but is shown moving to the left in the figure. The band 3 carrying fingers 13, which may be arranged either vertically or horizontally as indicated and each bearing a raised printing bar 4, is also shown. The view of the band 3, fingers 13, and printing bars 4 omits the anvils 5 which, for the sake of clarity, are not shown.

Each hammer face 5 has a width sufficient to span one or more character widths. The hammers are separated from each other by a small distance sufficient to eliminate the possibility of nipping or crashing. These terms are defined to mean a horizontal collision between the moving anvil 5 on a band finger element 13 moving as shown in the FIG. 3 upon the edge of an extended hammer 6. This usually may occur near one of the last printing positions indicated by the dotted lines showing last print position.

The height of each bar element 4 is slightly greater than the desired height of the total slope of the raised ridge portion 2 on platen 1. This allows each bar 4 to strike any area of the raised ridge 2 depending upon when hammer impact occurs.

As shown in FIG. 3, the band 3 is provided with a series of timing marks 14 schematically indicated as the timing track 14 on the lower edge of band 3. These marks are well known in the art and may comprise either optical slits or a similar emitter grid which can pass through a position emitter sensor of a form well known in the printer arts. Such devices are employed to generate a series of electrical timing pulses for accurately synchronizing the firing of hammers 6. The details of such synchronizing and timing controls are well known in the art and are not shown herein.

The design shown in these figures generates a fixed vertical pad with 64 or 72 pel per vertical inch being suggested. The tilting of the segments 2 on platen 1 is such that the paper motion will be compensated for and the interline space will be fixed to 1 over the vertical pel distance if maximum throughput is desired. The result of this is that after completing a row of dots, the next row can begin immediately since the paper will have advanced far enough by the printing of the last dot to commence printing the next row. The usual interline spacing between rows of printed characters is thus automatically accommodated by simply with holding start of printing until sufficient time has passed to allow one or more blank dot row times to pass.

The system will work well for hammer operations not requiring a pitch or print elements on the belt different from the hammer pitch or from some integral number of hammer pitches. As may be seen in FIG. 1, the pitch of the printing elements on belt or band 3 is twice that of the hammer pitch so that two hammers must be passed by each printing element on the band 3. As shown in FIG. 1, the pitch between printing elements can be chosen to be an integral number of hammer pitches. Each hammer face can be advantageously chosen to span an integral number of desired character widths, typically two or more. The spacing of the printing elements 4 on band 3 is shown with a two to one difference in spacing.

This has some advantages since every other hammer face will thus not be aligned with an anvil or printing element at least half of the time. This eliminates the possibility of nipping or crashing previously alluded to and can reduce the peak electrical power dissipated to one-half since only half of the hammers will be activated during an equal amount of time. Total power remains approximately the same since the same number of hammer strikes will be required to generate a normal character.

Speeds of 1500 to 2000 lines per minute with present technology, assuming a 0.75 millisecond hammer repetition rate and one hammer for each dot element, can be attained. Continuous feeding of paper 9 requires the pitch of elements on band 3 to be an integral number of hammer face pitches. One, two or more, so long as it is a whole integral number, are acceptable. For the example shown in figures, because each dot bar 4 has two hammer faces 6 to pass, printing of the dots will take twice as long as it would with one hammer for each dot element. But no time will be lost in overall printing due to the fact that the paper is also being continuously moved. In a typical example, the throughput is the same since the time for moving the paper is approximately equal to the time for printing a row of dots with one hammer per dot element. Thus, there is additional time available since, although dots are printed only half as fast, there is twice the available printing time within the total time alloted for generating a row of dots because the usual paper moving time can be allocated to dot printing. This results in a possible reduction of hammer drivers 7 since a driver can be shared between two hammers as is known in the art, and only half the number of drivers as there are hammers will be required.

Also, a lower cost form-feeding operation is possible since the motor 12 can be a synchronous AC motor instead of an expensive DC stepping motor. There is also no necessary DC power supply for the forms feeding function which further reduces cost and complexity of the printer.

The ribbon 10 can be on either side of the paper 9. The front side facing the operator is generally preferred, but back printing is also often used.

Typical dimensions for the raised ridge portions 2 on platen 1 would have face of approximately 0.012 to 0.016 inch (0.3 mm 0.4 mm). The impacting bar members 4 carried on fingers 13 will have a similar width and a height as previously described of slightly more than the total vertical rise in the angled ridges 2 on platen 1.

Some further advantages of the present design will now be described. The problem of shadow printing alluded to earlier in this specification is alleviated in this design. Since only a very small portion of paper 9 will be deflected by the bar elements 4 (that portion being approximately the width of the bar element or only slightly greater) shadow printing is eliminated even where the hammer faces of the hammer 6 may span multiplie character widths in the desired printing line. This was not attainable with the aforementioned prior art designs since the full width of the hammer would deflect the same or greater amount of paper and could easily deflect paper or ribbon into one of the moving vertical bar segments on a moving band to cause the shadow printing or smearing effect previously described.

Secondly, since at least one of the dot forming elements remains in fixed position in the present design, the raised ridges 2 and platen 1 being firmly and rigidly held in place, there is one less degree of freedom in the system. This simplifies the problem of designing the mechanism. Also the timing and synchronization of the elements is simplified since minor variations in hammer flight time and belt velocity can be more easily accommodated.

In addition, wear on the hammers may be reduced both by reducing the electrical duty cycle as noted by supplying several hammers for each element and by the fact that the hammer faces do not have to be knife edges to impact the anvils 5.

As will be understood by those skilled in the art, various modifications may be made to the present design without destroying the inventive aspects. For example, if continuous forms feeding and the resultant higher printing throughput can be dispensed with, the raised ridges 2 need not be inclined on platen 1 and a simple stepwise paper feeding mechanism can be employed.

Similarly, while the fingers 13 on belt 3 have been shown in both the vertical and horizontal orientations, it is generally preferred to orient the fingers in the horizontal orientation as shown in FIG. 3 with the leftmost or leading edge of the finger being the part that is rigidly affixed to or integral with belt 3. Other styles and designs of fingers 13 on the belt 3 are known in the art and will be apparent to those skilled therein.

Also, hammer 6 and driver 7 are well known in the art and need no further description herein.

The drive pulleys 8 shown in FIG. 1 move the band 3 at a constant velocity and the driven by a suitable synchronous AC motor or the like. The function of the timing marks 14 on band 3 is well known in the art, it being understood that the marks 14 being either optical or magnetic or the equivalent are spaced relative to the printing elements 4 in such a manner that once the emitter or pickup senses the marks, the firing of print hammers can be accurately timed by counting marks passing a given point.

Other elements such as some means not shown for moving the ribbon 10 are equally well known as are the paper tractors 11 and drive motor 12, all of which are commonly employed in a variety of printers.

The novel aspect of placing one of the dot forming elements in the form of a raised fixed ridge on a platen and the other element being in the form of the movable ridge on a moving band to be impacted by a fixed position hammer achieves a design of lower cost, higher reliability and greater utility since it avoids some of the inherent problems in previous designs as pointed out.

Having thus described my invention with reference to the above drawings depicting a preferred embodiment thereof, what is desired to be protected by Letters Patent is set forth in the claims as follows:

1. A dot matrix printer comprising:

a fixed platen having at least one raised ridge on an impact face thereof said raised ridge being relatively elongated measured along the line of printing;

a movable carrier means being provided with at least one raised edge font member of a first relatively narrow width measured along the line of printing, said carrier means being arranged to traverse the face of said raised ridge on said fixed platen and positioned relative thereto to be generally parallel with and along a desired printing line;

at least one print hammer having an impact face elongated, to a second width measured along the line of printing, said second width being substantially greater than said first width and oriented parallel with the intended printing line; and means for driving said print hammer to impact said movable carrier to deflect said raised ridge font member thereon into contact with a third relatively narrow area of paper to deflect said area of paper into contact with said raised ridge portion of said platen, said third width being substantially less than said second width a dot having an area substantially less than that of either raised ridge being formed of the size and shape corresponding to the area of impact between said raised ridge font member's impact face and said raised ridge of said platen.

2. Printing apparatus as described in claim 1, wherein:

said raised ridge font member on said movable carrier means is in the form of a generally vertical raised ridge and is carried on an integrally formed deflectable finger flexibly mounted on said movable carrier means.

3. Apparatus as described in claim 1, wherein:

said movable carrier means comprises a continuously moving band of flexible material to which are affixed one or more deflectable finger portions on which fingers are borne said raised ridge font members and;

drive means connected with said movable carrier for continuously driving said movable carrier and said raised ridge font members thereon to traverse said platen.

4. Apparatus as described in claim 1 or 2, or 3, wherein:

said raised ridge of said platen being inclined relative to the path of motion of said movable carrier means past said platen by an angle sufficient to span a vertical distance of one divided by the vertical print pitch.

* * * * *